US007152277B2

(12) United States Patent
Jung et al.

(10) Patent No.: US 7,152,277 B2
(45) **Date of Patent: *Dec. 26, 2006**

(54) FILTER ASSEMBLY FOR CYCLONE TYPE DUST COLLECTING APPARATUS OF A VACUUM CLEANER

(75) Inventors: Il-du Jung, Gwangju (KR); Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 338 days.

This patent is subject to a terminal disclaimer.

(21) Appl. No.: 10/626,078

(22) Filed: Jul. 24, 2003

(65) Prior Publication Data

US 2004/0177471 A1 Sep. 16, 2004

(30) Foreign Application Priority Data

Mar. 13, 2003 (KR) ..... 10-2003-0015810
Jun. 26, 2003 (KR) ..... 10-2003-0042067

(51) Int. Cl.
*A47L 9/20* (2006.01)
*A47L 9/16* (2006.01)

(52) U.S. Cl. ..... 15/352; 15/353; 55/295

(58) Field of Classification Search ..... 15/347, 15/350–353; 55/295–298, 337, DIG. 3
See application file for complete search history.

(56) References Cited

U.S. PATENT DOCUMENTS 2,171,248 A * 8/1939 Berkel ..... 55/392
2,187,546 A * 1/1940 Strattner ..... 55/288
2,484,491 A * 10/1949 Daugherty ..... 55/290
2,594,456 A * 4/1952 Kroenlein ..... 55/296
2,639,780 A * 5/1953 Hardy ..... 55/296
2,976,558 A * 3/1961 Fain ..... 15/312.1
4,314,409 A * 2/1982 Cartier et al. ..... 34/82
4,710,207 A * 12/1987 Bodovsky et al. ..... 55/290
5,271,751 A * 12/1993 Lagler ..... 55/295
5,603,740 A * 2/1997 Roy ..... 55/283
6,521,006 B1 2/2003 Park et al.
6,757,933 B1 7/2004 Oh et al.
2001/0025395 A1* 10/2001 Matsumoto et al. ..... 15/353
2003/0019074 A1 1/2003 Oh et al.
2003/0221278 A1 12/2003 Oh
2004/0187253 A1* 9/2004 Jin et al. ..... 15/352
2004/0200029 A1* 10/2004 Jin et al. ..... 15/352

FOREIGN PATENT DOCUMENTS

DE 1059636 6/1959
DE 19938769 3/2001
DE 10247655 11/2003
DE 10327941 9/2004
EP 0245224 11/1987
EP 0482505 4/1992
EP 1023864 8/2000
GB 2358347 7/2001
GB 2377881 1/2003

(Continued)

*Primary Examiner*—Terrence R. Till
(74) *Attorney, Agent, or Firm*—Ladas & Parry LLP

(57) ABSTRACT

A vacuum cleaner, centrifugally separates contaminates from air and collects them in a filter assembly that includes a rotary filter connected to an exhaust port. The filter is provided with a suction grill portion at the outer circumference and a discharge port that is fluidly connected to the exhaust port of the cyclone type dust collecting apparatus. Contaminants accumulated on the outer surface of the filter are easily removed by rotating the filter in association with the dust receptacle.

18 Claims, 7 Drawing Sheets

FOREIGN PATENT DOCUMENTS

| | | | |
|---|---|---|---|
| GB | 2389064 | | 12/2003 |
| JP | 8010655 | | 1/1996 |
| JP | 2000 342492 | | 12/2000 |
| JP | 2002 315701 | | 10/2002 |
| JP | 2002-315701 | | 10/2002 |
| JP | 2003 038398 | | 2/2003 |
| JP | 2003 230516 | | 8/2003 |
| JP | 2003 339594 | | 12/2003 |
| KR | 2001049141 | * | 6/2001 |
| KR | 2001 0073930 | | 8/2001 |
| WO | WO 0134725 | | 5/2001 |

* cited by examiner

FILTER ASSEMBLY FOR CYCLONE TYPE DUST COLLECTING APPARATUS OF A VACUUM CLEANER

BACKGROUND OF THE INVENTION

1. Field of the Invention

The present invention relates generally to a cyclone type dust collecting apparatus of a vacuum cleaner, and more particularly, to a filter assembly disposed in a cyclone type dust collecting apparatus for filtering of contaminants, which are separated from whirling air by centrifugal force.

2. Description of the Background Art

Generally, a filter is disposed in a cyclone type dust collecting apparatus of a vacuum cleaner to filter out minute contaminants from an air stream, which is whirled around in a container of a cleaner body. With continued use, a layer of fine dust usually accumulates on the outer surface of the filter, and the filter has to be regularly cleaned, which is a quite cumbersome procedure. Recently, a filter cleaning device has been suggested to remove contaminants from the outer surface of the filter in association with the opening/closing of the dust receptacle of the cyclone type dust collecting apparatus.

FIG. 1 is a longitudinal cross-sectional view of a cyclone type dust collecting apparatus having a conventional filter cleaning device and FIG. 2 is a perspective detail view of the filter cleaning device of FIG. 1. As shown in FIG. 1, the cyclone type dust collecting apparatus 100 includes a cyclone body 110 in which a suction port 111 and a discharge port 121 are formed, a dust receptacle 103 removably connected to the cyclone body 110, and a filter 130 disposed on the discharge port 121 of the cyclone body 110 and extending within the dust receptacle 103.

The cyclone body 110 includes a receptacle connecting part 125, which defines a dust separating chamber 115, and a connecting pipe 113 extended from the dust separating chamber 115 to an elbow shape. The dust separating chamber 115 is provided with the suction port 111 open outwardly in an oblique or tangential direction, and the discharge port 121 is open in an upwardly direction. The suction port 111 provides fluid communication between the interior of the connecting pipe 113 and the dust separating chamber 115. A suction pipe 107 is connected to the end of the connecting pipe 113 of the vacuum cleaner, and has a dust suction part (not shown) formed thereon. A flexible pipe 109 is connected to the discharge port 121, which pipe 109 is connected to the cleaner body (not shown) of the vacuum cleaner to provide fluid communication therebetween.

The receptacle connecting part 125 of the cyclone body 110 is open in a downwardly direction, and is shaped and configured to receive therein a cylindrical dust receptacle 103, which has an upper opening formed therein. There is a gasket 141 disposed between the receptacle connecting part 125 of the dust separating chamber 115 and the outer surface of the opening of the dust receptacle 103, for providing an airtight seal to the connection. Meanwhile, the dust receptacle 103 has a hook 104 protruding from the outer lower side and extending toward the connecting pipe 113 of the cyclone body 110. A hook recess 114, formed on the outer surface of the connecting pipe 113 in correspondence with the hook 104 is capable of engaging the hook 104, which is hooked or unhooked from the hook recess 114.

As described above, the filter 130, connected with the discharge port 121 of the dust separating chamber 115, is received within the dust receptacle 103 that is itself connected to the lower portion of the dust separating chamber 115. The filter 130 preferably is in the shape of a cylinder having an upper open end, and a plurality of air holes formed in the outer diameter circumference. A net body 135 is disposed on the outer diameter side of the air holes. The net body 135 includes a plurality of fine holes for filtering the fine contaminants from the air passing through the filter.

As shown in FIG. 2, the conventional filter cleaning device 150 mounted in the cyclone type dust collecting apparatus is provided with a dust removing ring 151 disposed around the outer diameter portion of the filter 130 (FIG. 1). A spring 155 (FIG. 1) resiliently biases the dust removing ring 151 downwardly, and a slider 161 and a locking lever 171 mutually engage each other for securing the dust removing ring 155 in the upper portion of the filter 130. A guiding groove portion 157 (FIG. 1) formed between the connecting pipe 113 of the cyclone body 110 and the dust receptacle 103, is provided for guiding upward and downward sliding of the slider 161.

The slider 161 is a bent member, which is extended downwardly from the outer surface of the dust removing ring 151 and is slidably received in the guiding groove portion 157 to slide thereon in the upward and downward directions. The slider 161 includes a connecting protrusion 162 formed to correspond with a protrusion hole (not shown) of the dust receptacle 103. With the cooperation of connecting protrusion 162 and the protrusion hole (not shown) of the dust receptacle 103, the dust receptacle 103 can slide upwardly and downwardly together with the slider 161. That is, in association with the sliding of the slider 161, the dust receptacle 103 is engaged or disengaged with respect to the cyclone body 110. The slider 161 is also provided with a pair of locking recesses 165, 166 formed along a longitudinal edge at predetermined intervals.

The locking lever 171 is provided with a locking portion 172 that moves with respect to the locking recesses 165, 166 of the slider 161, and an operating portion 174 for operation by the user. The locking lever 171 is rotated on a rotary axis pin 176 disposed in the guiding groove portion 157 (FIG. 1), engaging the locking portion 172 with respect to the locking recesses 165, 166 of the slider 161. To this end, there is provided a locker spring 181 disposed on the side removed from the locking portion 172 to resiliently bias the locking portion 172 towards the locking recesses 165, 166.

During use of the above construction of the conventional cyclone type dust collecting apparatus 100 having the filter cleaning device 150, the dust receptacle 103 can be separated by pressing the operating portion 174 of the locking lever 171. Accordingly, in response to the separation of the dust receptacle 103, the filter cleaning device 150 is operated. As the operator presses the operating portion 174 to rotate the operating portion 174 on the rotary axis pin 176, the locking portion 172 disengages from the locker recesses 165, 166 of the slider 161. The recovery force of the spring 155 biases the dust receptacle 103 downwardly and it is separated from the cyclone body 110, and at the same time, the dust removing ring 151 and the slider 161 slide in the downward direction.

The dust removing ring 151 wipes the dust layer from the outer diameter side of the filter 130 as it slides down and through the ring 151, and the dust falls into the dust receptacle 103 and is collected therein. When the dust receptacle 103 is full, the operator disengages the connecting protrusion 162 of the slider 161 from the protrusion hole of the dust receptacle 103, and throws out the dust and contaminants collected therein. After being emptied, the dust receptacle 103 is again connected to the receptacle connecting portion 125 (FIG. 1) of the cyclone body 110 by pressing upwardly, and following the reverse order to the procedure described above.

However, the conventional filter cleaning device 150 of the cyclone type dust collecting apparatus 100 described above has several drawbacks. That is, when large amounts of minute contaminants accumulate on the outer surface of the filter 130 , the dust removing ring 151 is inhibited from sliding smoothly and thus, it can not efficiently remove the minute contaminants from the filter 130. The operator also experiences inconvenience whenever the ring 151 becomes clogged by the dust and contaminants, forcing the operator himself/herself to remove the minute contaminants from the outer diameter surface of the filter 130 and so to enable the dust removing ring 151 to smoothly slide along the filter surface.

Further, the conventional filter cleaning device 150 of the cyclone type dust collecting apparatus 100 is a relatively complex structure, which requires many parts, such as, the slider 161, the locking lever 171 and the locker spring 181. This complexity results in manufacturing cost increases and in complicated assembling/disassembling procedures. Also, due to the structural requirements in the conventional filter cleaning device 150 of the cyclone type dust collecting apparatus 100 in which the guiding groove portion 157 for upward/downward sliding of the slider 161 is formed between the connecting pipe 113 of the cyclone body 110 and the dust receptacle 103, expensive molds providing such a complex structure are required and as a result, the manufacturing cost increases even more.

SUMMARY OF THE INVENTION

Accordingly, it is an aspect of the present invention to provide a filter assembly for use as a cyclone type dust collecting apparatus of a vacuum cleaner, having a rotating filter, which is rotatable and is capable of easily removing contaminants accumulated thereon by rotation of the filter.

It is another aspect of the present invention to provide a filter assembly for use as a cyclone type dust collecting apparatus of a vacuum cleaner having a simple structure, thus enabling manufacturing at a reduced cost, and also providing a structure that is easy to assemble and disassemble and easy to remove the dust receptacle from the body.

It is yet another aspect of the present invention to provide a filter assembly, which requires no guiding groove portion between the dust receptacle and the connecting pipe of the cyclone body, and thus is easy to manufacture using a simple mold structure.

In order to accomplish the above aspects and/or features of the present invention, in a cyclone type dust collecting apparatus of a vacuum cleaner which centrifugally separates contaminants from an externally-drawn air and collects the separated contaminants therein, a filter assembly filters contaminants floating in an air which is discharged through an exhaust port of the vacuum cleaner. The filter assembly includes a rotary filter rotatably connected with respect to the exhaust port of the cyclone type dust collecting apparatus, and a filter rotating unit. The rotary filter includes a suction grill portion disposed at the outer circumference and a discharge port in fluid communication with the exhaust port, and the filter rotating unit is for rotating the rotary filter within the dust collecting apparatus, thereby removing the contaminants filtered on the suction grill portion and depositing them into a removable dust receptacle engaged to the cyclone type dusty collecting apparatus.

The filter rotating unit includes a connecting portion open in a downward direction with respect to an axis of the rotary filter, an operating bar extending upwardly from the bottom of the dust receptacle of the cyclone type dust collecting apparatus, for operating in association with the connecting portion of the rotary filter, and a rotation driving portion, disposed between the operating bar and the connecting portion, capable of rotating the rotary filter in association with the engagement and disengagement of the dust receptacle.

The rotation driving portion includes an operating groove formed on an outer surface of the operating bar extending along a lengthwise direction in a helical screw-wise pattern, and a driven protrusion formed in the connecting portion for corresponding to the operating groove, whereby engagement of the groove with the protrusion causes the rotation of the rotary filter. Alternatively, the operating protrusion is formed on an outer surface of the operating bar extending along a lengthwise direction in a helical screw-wise pattern, and the driven groove is formed in the connecting portion for corresponding to the operating protrusion.

BRIEF DESCRIPTION OF THE DRAWINGS

The above aspects and other features of the present invention will become more apparent by describing in detail a preferred embodiment thereof with reference to the attached drawings, in which.

DETAILED DESCRIPTION OF THE PREFERRED EMBODIMENTS

Hereinafter, the present invention will be described in detail with reference to the accompanying drawings.

Figure 3:
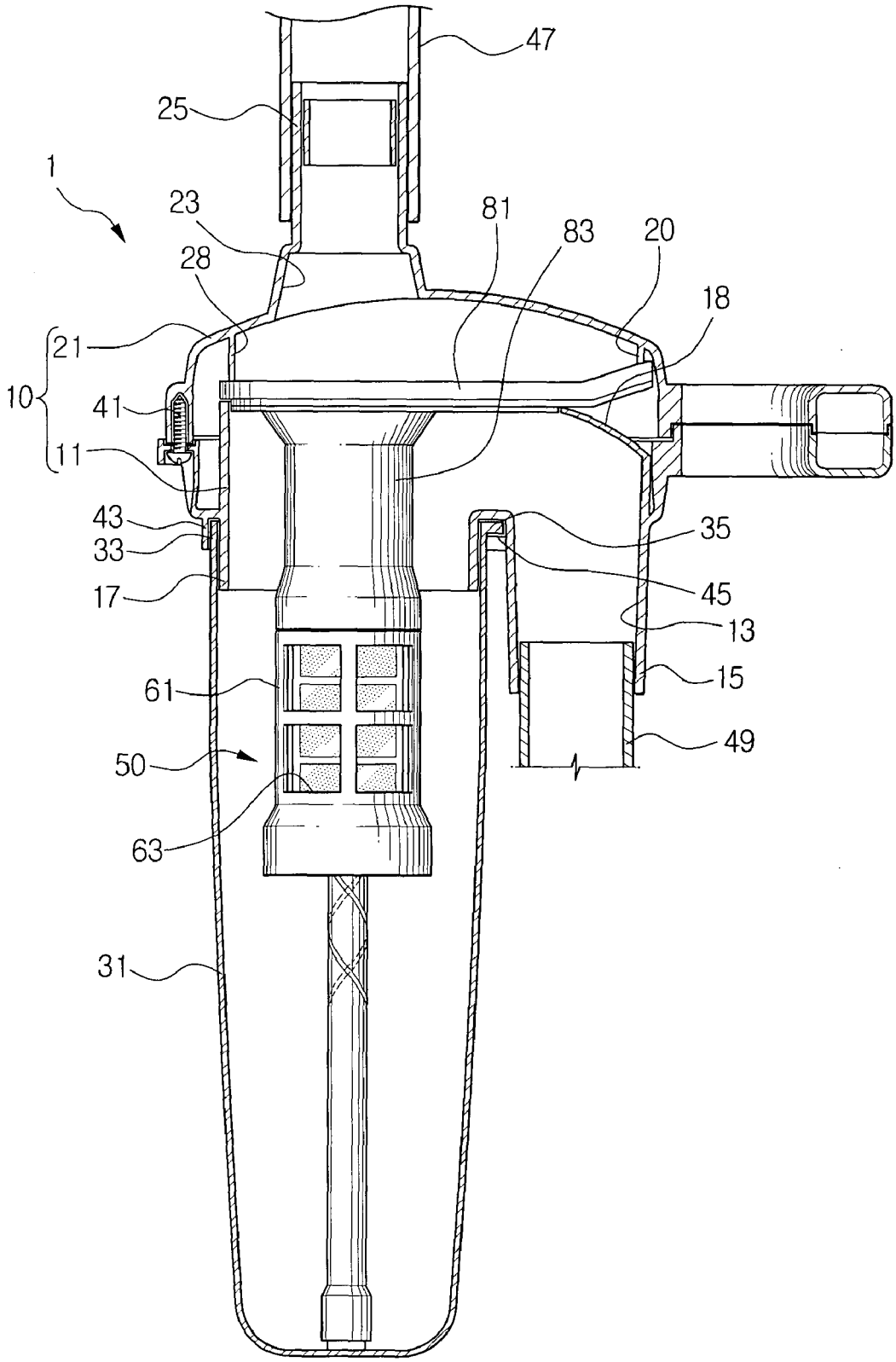
FIG. 3 is a partial, cross-sectional view of a cyclone type dust collecting apparatus having a filter assembly mounted therein according to the present invention.

FIG. 3 is a partial, cross-sectional view of a cyclone type dust collecting apparatus having a filter assembly mounted therein according to the present invention. As shown in FIG. 3, the cyclone type dust collecting apparatus 1 having a filter assembly 50 mounted therein, is provided with a cyclone body 10 having an intake port 13 and an exhaust port 23 formed therein, and a dust receptacle 31 removably connected to the cyclone body 10. The filter assembly 50 preferably is mounted adjacent the exhaust port 23 of the cyclone body 10 and disposed within the dust receptacle 31.

The exhaust port 23 is part of an upper body 21 of the cyclone body 10. A lower body 11 including the intake port 13, is connected with upper body 21 by an appropriate means, such as a plurality of screws 41, one of which is shown in FIG. 3. The exhaust port 23 of the upper body 21 is open in an upward direction, and an exhaust side connecting pipe 25 extends upwardly from the side of the exhaust port 23 away from the filter assembly 50. The exhaust side connecting pipe 25 is connected to a flexible connecting pipe 47, which is connected to a cleaner body of the vacuum cleaner (not shown).

The lower body 11 includes the intake port 13, which is open in the downward direction, and a downwardly open receptacle connecting portion 17 is provided in parallel relation with the intake port 13. An intake side connecting pipe 15, in fluid communication with the lower body 11, is connected with an intake pipe 49, which itself is connected to a dust suction portion (not shown). A connecting rib 43 disposed on the outer surface of the receptacle connecting port 17 is shaped and configured to receive a connecting edge 33 of the dust receptacle 31. The connecting rib 43 is provided at portions thereof with a connecting slit 45 cut in a horizontal direction.

Figure 1:
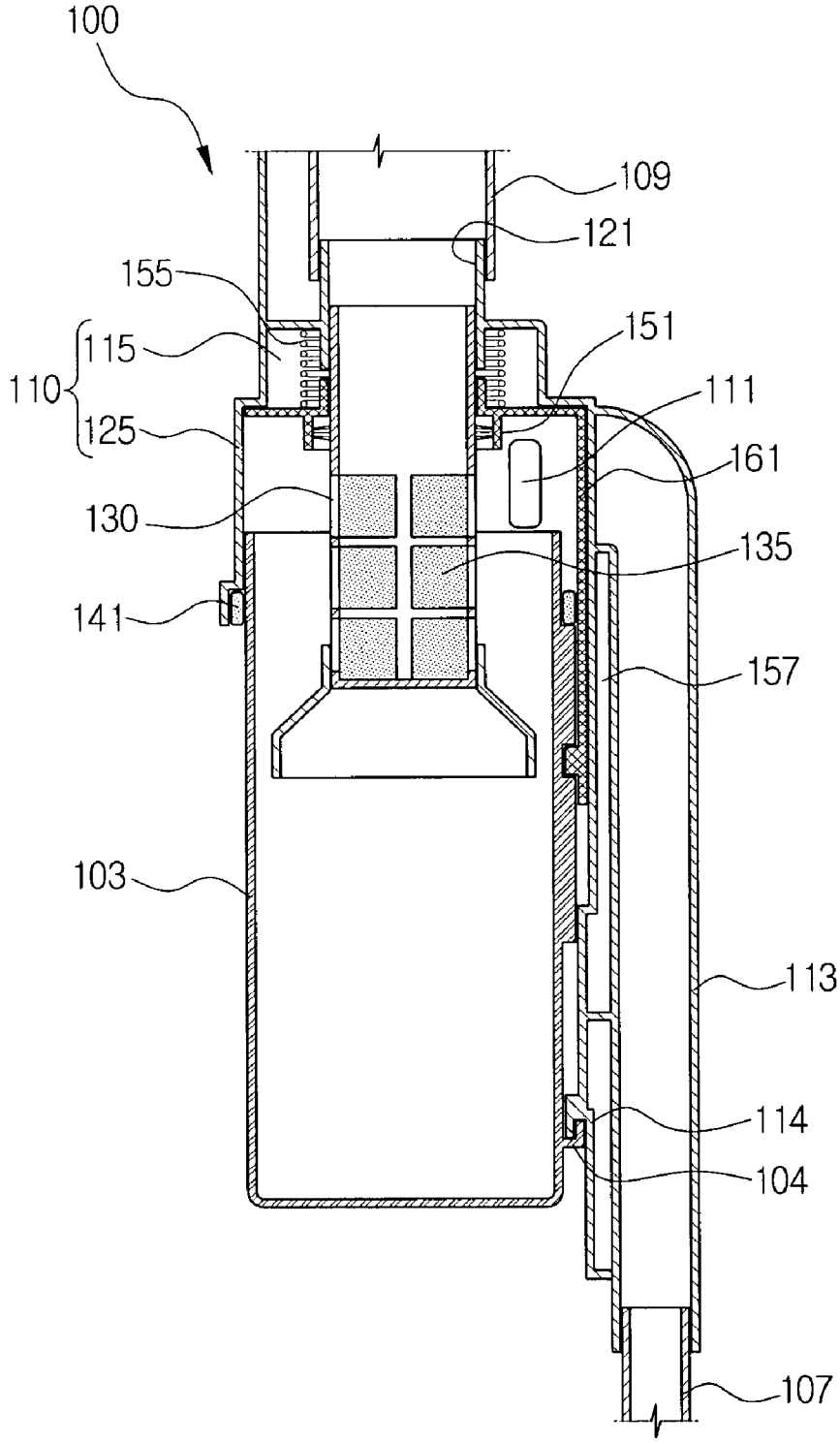
FIG. 1 (PRIOR ART)
FIG. 1 is a longitudinal cross-sectional view of a cyclone type dust collecting apparatus of a vacuum cleaner having a conventional filter cleaning device installed therein.
Figure 2:
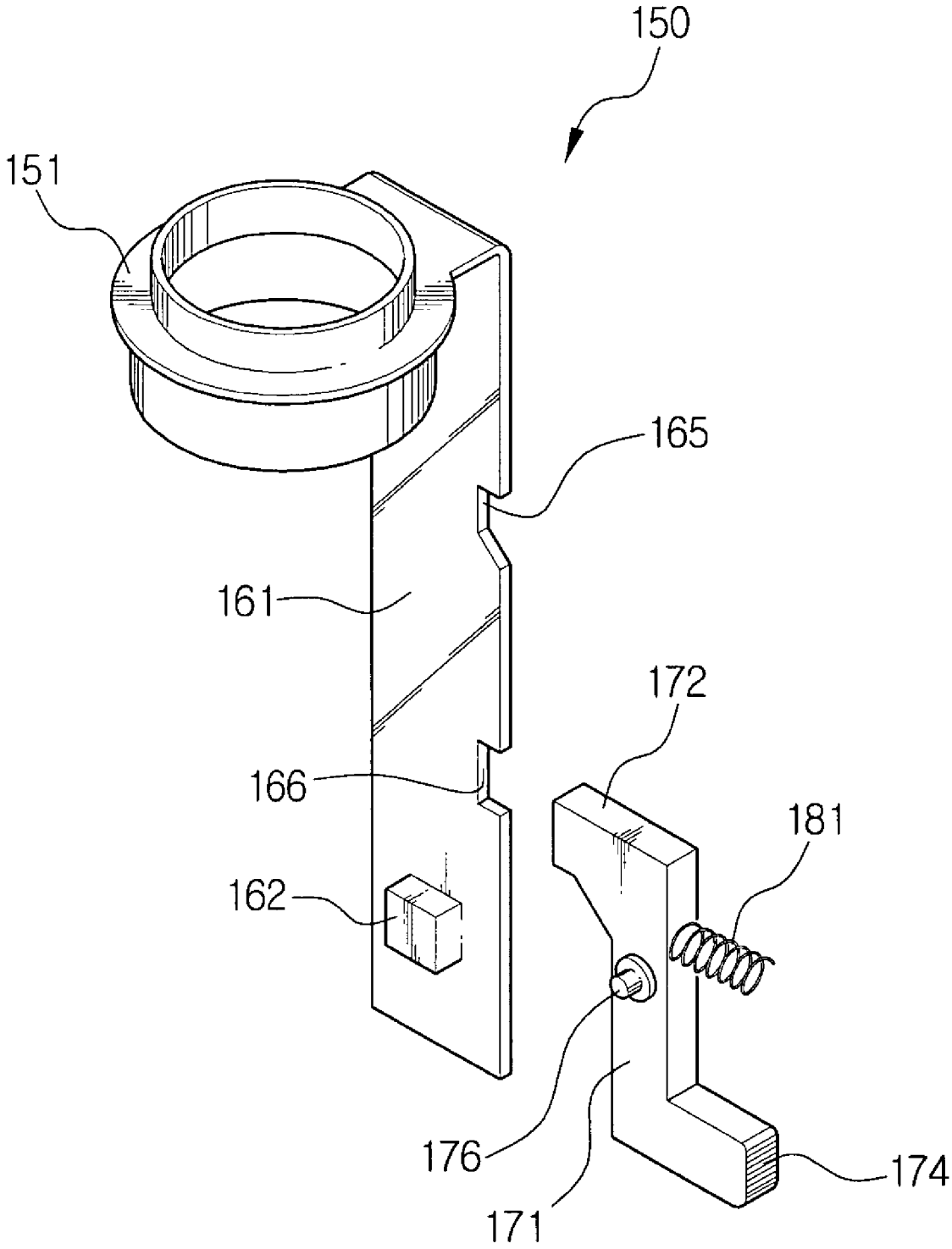
FIG. 2 (PRIOR ART)
FIG. 2 is a partially-enlarged perspective view of FIG. 1, illustrating in detail the conventional filter cleaning device.

The dust receptacle 31 is substantially a cylinder, which is open upwardly, and includes the connecting edge 33 at an end thereof. Unlike the conventional dust receptacle 103 (FIG. 1), the dust receptacle 31 according to the present invention has a simple structure from which parts, such as the guiding groove portion 157 (FIG. 1) for receiving the sliding portion and a protrusion hole, are omitted. The connecting edge at the opening side of the dust receptacle 31, away from the intake side connecting pipe 15, is received in the connecting rib 43. A hooking protrusion 35 protrudes from the connecting edge 33 and is used for engaging with the connecting slit 45. With the connecting edge 33 of the dust receptacle 31 being received in the connecting rib 43 of the receptacle connecting portion 17, the dust receptacle 31 is turned in a clockwise or counterclockwise direction. Accordingly, the hooking protrusion 35 is received in the connecting slit 45. In other words, the dust receptacle 31 is removably engaged with respect to the cyclone body 10 by rotation of the dust receptacle 31.

Figure 4:
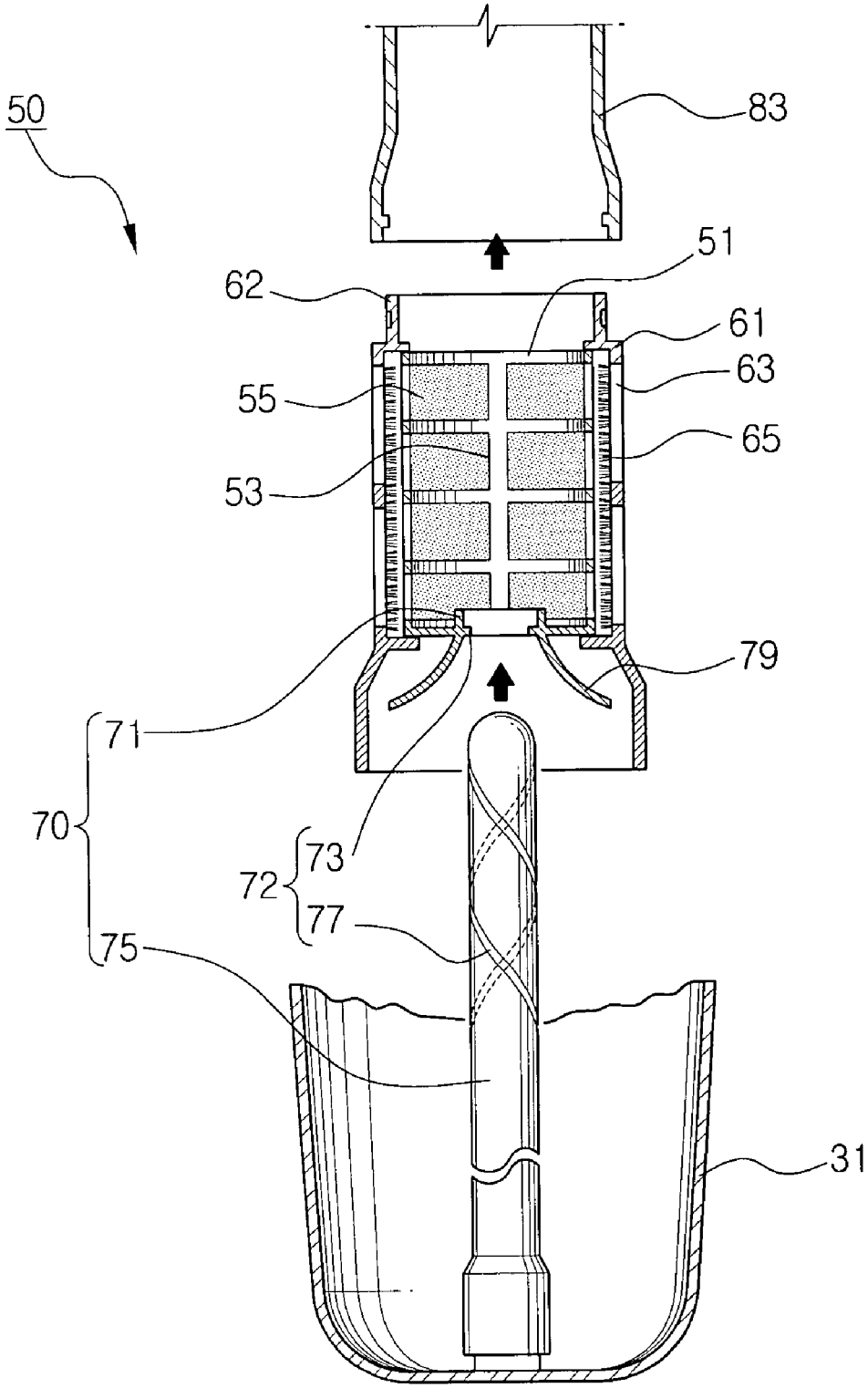
FIG. 4 is a partially enlarged, and exploded cross-sectional view of FIG. 3, illustrating in detail the structure of the filter assembly.
Figure 5:
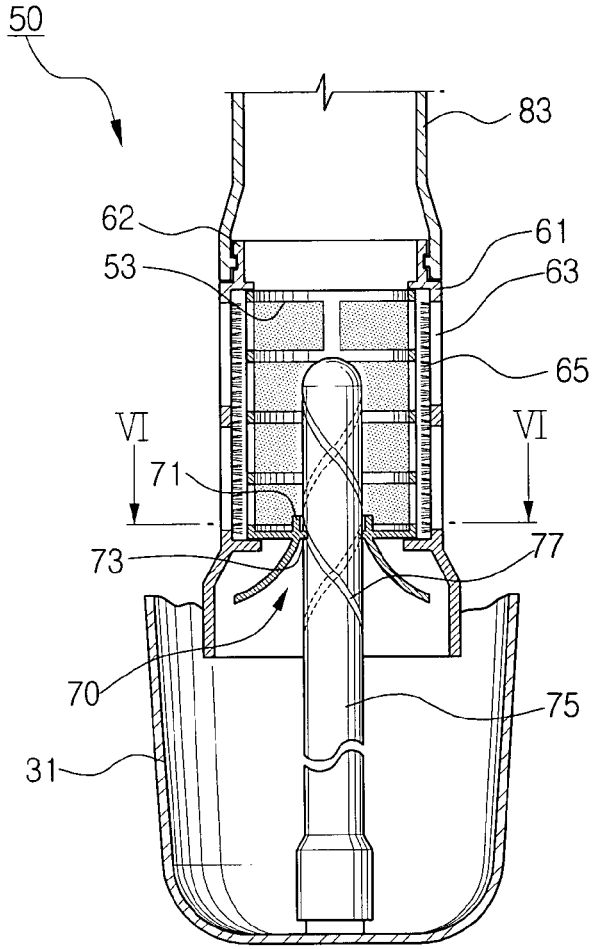
FIG. 5 is a cross-sectional view illustrating parts shown in FIG. 4 after assembly.

FIG. 4 is a partially enlarged, and exploded, cross-sectional view of FIG. 3, illustrating in detail the structure of the inventive filter assembly, and FIG. 5 is a cross-sectional view illustrating the structure of the filter assembly in greater detail. As shown in the figures, the filter assembly 50 according to the present invention is constructed in a relatively simple manner by providing the structure of a filter 51 that is rotatable with respect to the exhaust port 23 of the upper body 21 of the cyclone body 10, and a filter rotating unit 70 for rotating the filter 51. Additionally, a dust backflow preventing plate 81 may be used for rotatably securing the filter 51, as described below.

The dust backflow preventing plate 81 is disposed between the upper and lower bodies 21, 11 of the cyclone body 10. Fixation ribs 18, 28 protrude from the upper and lower bodies 21, 11 of the cyclone body 10, respectively, to maintain engagement between bodies 21, 11. The dust backflow preventing plate 81 divides the interior space defined by the upper and lower bodies 21, 11 into upper and lower spaces. The dust backflow preventing plate 81 preferably includes a discharge hole (not shown) for providing fluid communication between the lower body 11 and the upper body 21, and a filter securing pipe 83, sealed against the dust backflow preventing plate 81, is disposed adjacent the discharge hole.

As described in detail below, the filter securing pipe 83 is connected at its lower portion with a rotation supporting portion 61 that rotatably supports the filter 51. At the end opposite the filter 51, the filter securing pipe 83 may be integrally formed with the dust backflow preventing plate 81 in a simple manner, for example, by injection molding. Alternatively, the filter 51 and the rotation supporting portion 61 can be connected directly with the discharge hole of the dust backflow preventing plate 81 without requiring the filter securing pipe 83. In yet another alternative embodiment, the filter and the rotation supporting portion 61 are connected directly to the exhaust port 23 of the upper body 21 without requiring the filter securing pipe 83 and the dust backflow preventing plate 81.

The filter 51 is substantially a cylinder, which is open in the upward direction, and is provided with a suction grill portion 53 formed in the outer circumference. The suction grill portion 53 may be formed to have a plurality of filtering holes for filtering out minute contaminants from the air drawn into the cyclone body 10. For better filtering, however, the suction grill portion 53 is formed with a plurality of openings, and a net-type filtering member 55 is disposed over the outer sides of the openings, respectively, as shown in FIG. 4. The open upper side of the filter 51 serves as a discharge port which is in fluid communication with the exhaust port 23, and is used for discharging air which is filtered through the suction grill portion 53 into the filter securing pipe 83.

The rotation supporting portion 61 in cylindrical shape is preferably disposed along the outer surface of the filter 51. The rotation supporting portion 61 has open upper and lower sides, and also includes a plurality of suction windows 63 formed in its outer circumference. The upper open side 62 of the rotation supporting portion 61 is securely connected to the lower end of the filter securing pipe 83, and the filter 51 is received in the secured rotation supporting portion 61 to be rotatable in relation thereto. The rotation supporting portion 61 may also be connected and secured to the directly discharge hole of the dust backflow preventing plate 81, or to the discharge port 23 of the upper body 21 of the cyclone body 10, as described above.

The rotation supporting portion 61 is also provided with a brush portion 65 along the inner circumference extending in a vertical direction, as shown in FIG. 4. A plurality of brush portions 65 may be disposed in parallel relation extending in the vertical direction between the inner circumference surface of the rotation supporting portion 61 and the outer circumferential surface of the filter 51. Preferably each brush portion 65 is arranged in the surface between the respective suction windows 63. The brush portions 65 come into contact with the outer circumference of the filter 51, and remove the accumulated dust from the outer surface of the filter 51 during the rotation of the filter 51 inside the rotation supporting portion 61.

The filter rotating unit 70 includes an operating bar 75 extending upwardly from the bottom of the dust receptacle 31, a connecting portion 71 open at the lower portion of the filter 51 for receiving the operating bar 75 therein, and a rotation driving portion 72, disposed between the operating bar 75 and the connecting portion 71. The operating bar 75 may be integrally formed with the dust receptacle 31, for example by injection molding, or may be formed as a separate member connected to the dust receptacle 31.

Figure 6:
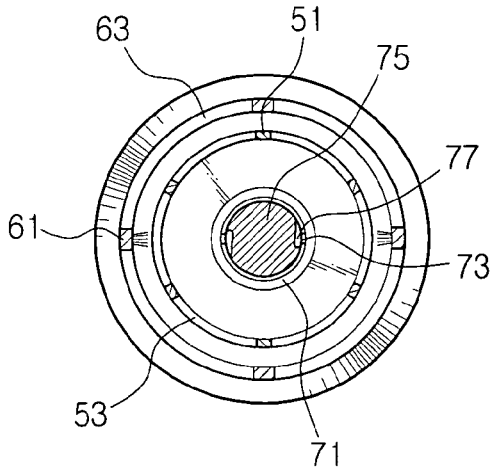
FIG. 6 is a cross-sectional view taken approximately along line VI—VI of FIG. 5.

The rotation driving portion 72 may be formed having a simple construction, including one or more operating grooves 77 scored on the outer circumference of the operating bar 75, and a driven protrusion 73 protruding from the inner circumference of the connecting portion 71. The operating groove 77 is preferably scored in a helical or screw-wise shape to extend along a lengthwise direction of the operating bar 75. The driven protrusion 73 protrudes from the inner circumference of the connecting portion 71 and is received in the operating groove 77. It is preferable to provide the operating groove 77 and the driven protrusion 73 in pairs, as shown in FIG. 6, while it is also possible to provide one operating groove 77 and one driven protrusion 73, respectively. Accordingly, in accordance with the operation of the rotation driving portion 72, as operating bar 75, which is received in the connecting portion 71, is pushed in an upwardly direction, the driven protrusion 73 rotates along the screw-shaped operating groove 77 and as a result, the filter 51 is rotated around the central axis within the rotation supporting portion 61.

Preferably, the filter rotating unit 70 additionally includes a flared operating bar guide 79, which extends vertically from the open side of the connecting portion 71. The operating bar guide 79 also extends horizontally as well as vertically, to have a divergent surface toward the operating bar 75, thereby forming an inclination relative to the central axis. The divergent surface of the operating bar guide 79 guides the separated operating bar 75 into position so that the operating bar 75 can enter smoothly into the open side of the connecting portion 71.

The operation of the cyclone type dust collecting apparatus 1, having the filter assembling 50 constructed as above, will be described below. As dust-laden air is drawn into and through the suction pipe 49, it flows into the intake port 13, and due to the tangential shape of intake port 13, the air spins about the filter 51 within the lower body 11 of the cyclone body 10. The cyclonic movement of the air causes the contaminants and large-particle dust to be separated by the centrifugal force of the spinning air current. After this process, minute contaminants still entrained in the air are filtered out as the air is passed through the filter 51. Accordingly, only clean air is discharged through the exhaust port 23.

The dust receptacle 31 is easily emptied, because the dust receptacle 31 is easily removable from the cyclone body 10 As described above, the dust receptacle 31 is separated from the cyclone body 10 by hooking the hooking protrusion 35 from the connecting slit 46 and pulling the dust receptacle 31 in a downward direction. As the dust receptacle 31 is pulled downwardly, the operating bar 75 received in the connecting portion 71 of the filter 51 also moves downwardly together with the dust receptacle 31. Accordingly, the driven protrusion 73 is rotated by the inclined motion of the operating groove 77 of the operating bar 75, and the filter 51 is rotated.

The rotational force of the filter 51 by itself can cause the dust disposed on the surface to be removed from the outer surface of the filter 51. In this embodiment, the filter 51 is housed within the rotation supporting portion 61 and is rotated in rotation relative thereto, thereby causing the pile of dust on the filter 51 to be completely removed by the brush portion 65 of the rotation supporting portion 61. The dust fall and is collected in the dust receptacle 31, as it is removed by the rotation of the filter 51, and the operator can easily empty the dust receptacle 31 as the need arises.

In order to re-mount the dust receptacle 31 to the cyclone body 10, the operating bar 75 is guided by the operating bar guide 79, which is formed at the connecting portion 71. While the operating bar 75 is re-connected to the connecting portion 71, the filter 51 is rotated in a reverse direction by the counter-operation of the operating groove 77 and the driven protrusion 73, again removing any remaining dust from the outer surface of the filter 51. As described above, during the cleaning operation of the vacuum cleaner, air discharge is always performed smoothly because the suction grill portion 53 remains completely clean.

Figure 7:
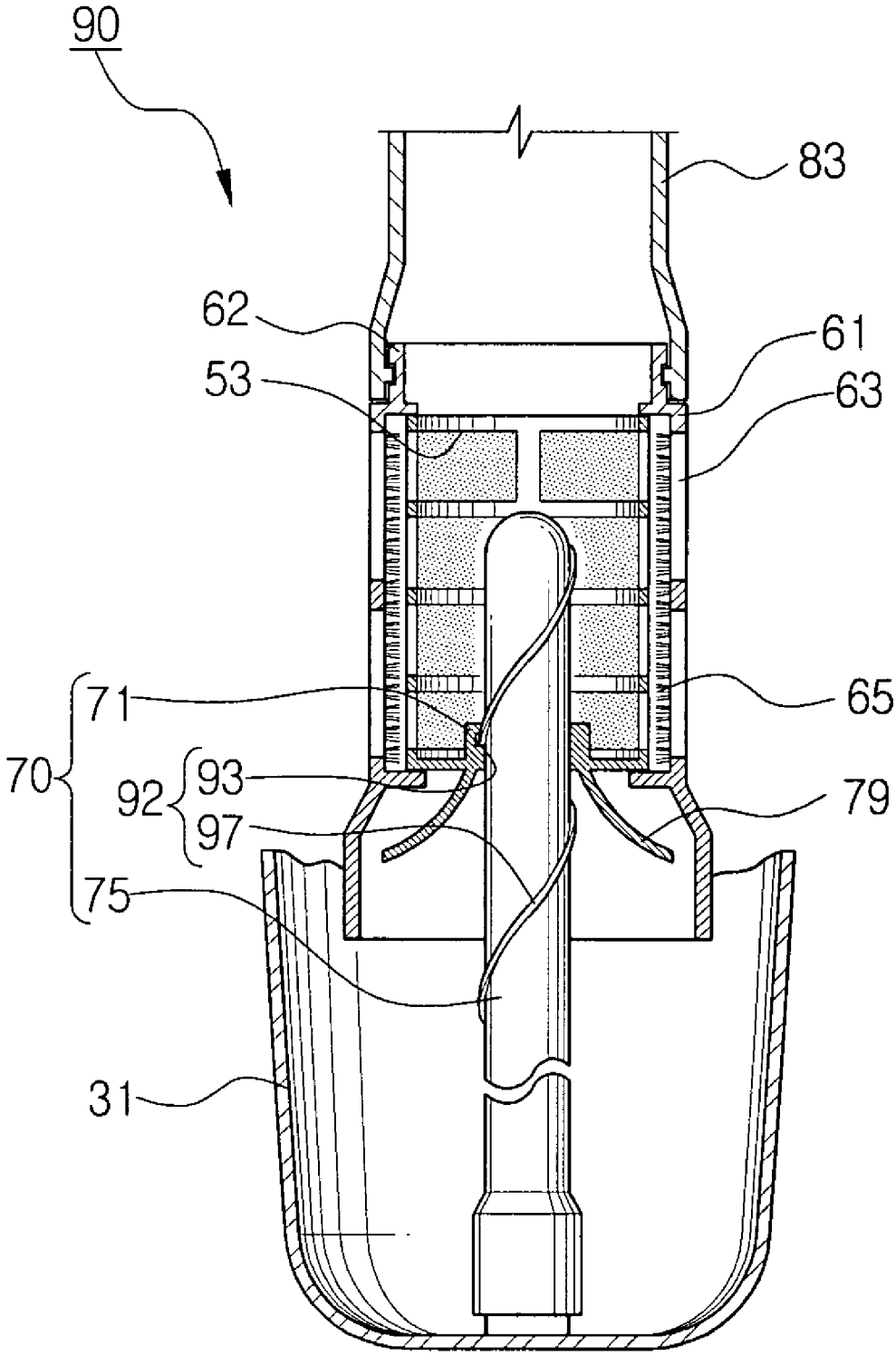
FIG. 7 is a cross-sectional view of the filter assembly having a rotation driving portion according to another preferred embodiment of the present invention.

With reference to FIG. 7, an exploded, cross-sectional view of a filter assembly having a rotation driving portion according to another preferred embodiment of the present invention is illustrated. The second embodiment of the present invention is similar to the first embodiment, described above with reference to FIGS. 4 to 6, except that the elements on which the protrusion and grooves are disposed are interchanged. For example, the operating bar 97 is formed on the operating protrusion 75, and the rotation driving portion 92 in the form of a groove 93 is formed on the connecting portion 71 of the filter 51. Accordingly, only the rotation driving portion 92 will be described below.

According to the second embodiment of the present invention, the rotation driving portion 92 is provided with an operating protrusion 97 protruding from the outer surface of the operating bar 75 in a helical or screw-wise pattern, and a driven groove 93 is scored on the connecting portion 71 of the filter 51. The driven groove 93 is formed along the inner circumference of the connecting portion 71 so as to be oriented at a predetermined inclination, while the operating protrusion 97 is formed in a corresponding inclination to fit within the driven groove 93.

Accordingly, the operating bar 75 is received in the connecting portion 71 and by moving the operating bar 75 in a vertical direction, the operating protrusion 97 is moved along the driven groove 93 of the connecting portion 71. Because of the inclined surfaces, the operating protrusion 97 sliding within the groove 93 causes the filter 51 to rotate. The same effect is expected from the rotation of the filter 51 in the second embodiment as that of the first embodiment, and detailed description thereof will not be repeated herein as being duplicative of the above description in relation to the first embodiment.

Figure 8:
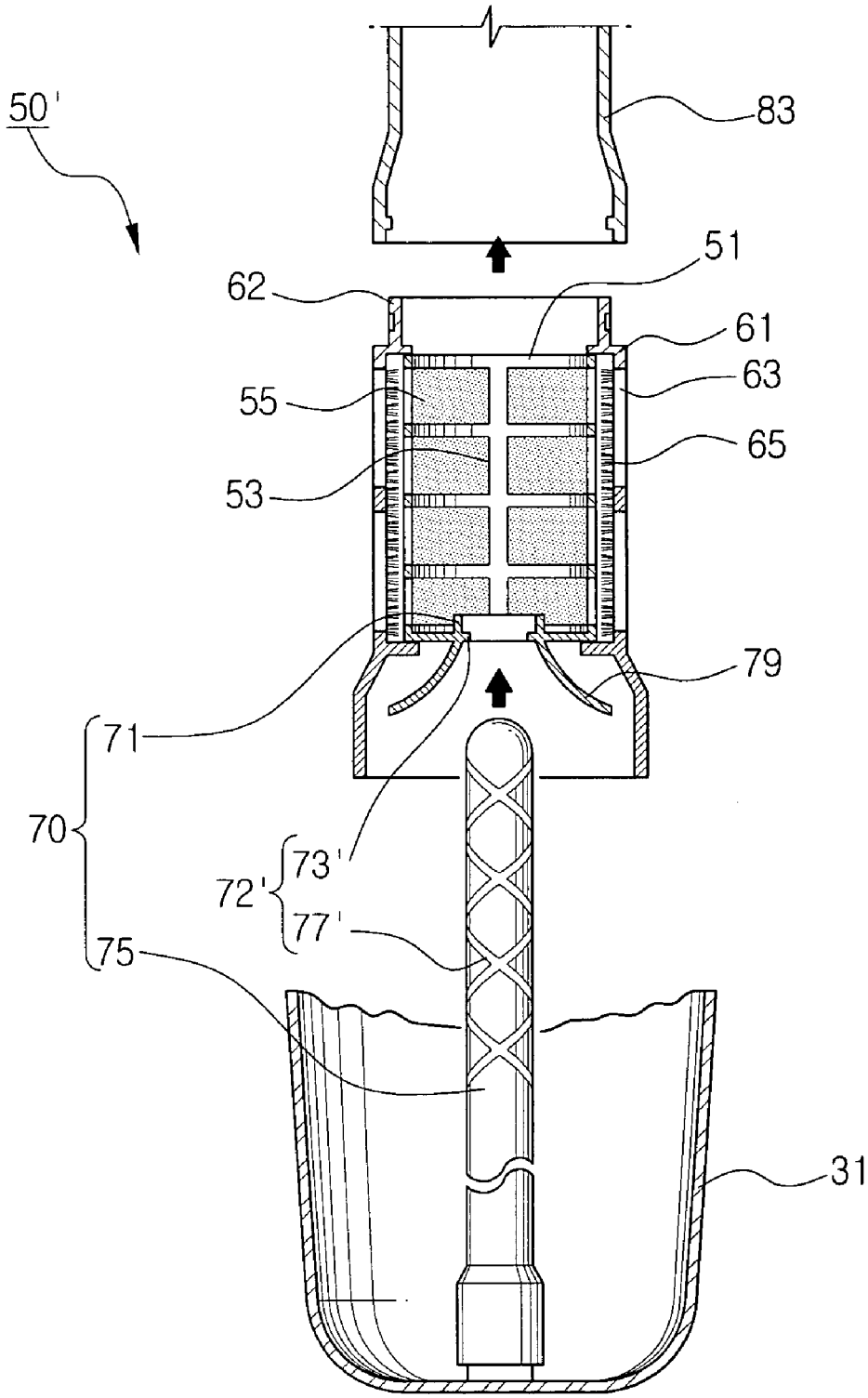
FIG. 8 is a cross-sectional view of the filter assembly having a rotation driving portion according to yet another preferred embodiment of the present invention.

Meanwhile, FIG. 8 is an exploded, cross-sectional view of a filter assembly having a rotation driving portion according to another preferred, i.e., the third embodiment of the present invention. The third embodiment of the present invention is similar to the first embodiment, described above with reference to FIGS. 4 to 6, except that the operating groove 77' formed on the outer surface of the operating bar 75 has a different configuration. According to the third embodiment, there are total four operating grooves 77' extending along the operating bar 75 along a lengthwise direction in a helical, or screw-wise pattern.

That is, a pair of operating grooves 77' start from the leading end of the operating bar 75, i.e., from where the driven protrusion 73' is received, one in the right direction and the other in the left direction, and then these two grooves 77' are branched into four grooves 77'. The four left and right operating grooves 77' cross each other on the outer surface of the operating bar 75, forming substantially a diamond pattern when viewed from a side. According to this construction, the driven protrusion 73' entering into the starting point of the operating grooves 77' is downwardly moved along one of the left and right operating grooves 77'. In the first and the second preferred embodiments described above, in association with the entrance of the operating bar 75 with respect to the connecting portion 71, the filter 51 rotates in one direction, and then rotates in the opposite direction as the operating bar 75 retreats. According to the third preferred embodiment of the present invention, the filter 51 is rotated in a selected direction irrespective of the entrance or retreat of the operating bar 75. That is, the filter 51 is rotated in association with the movement of the driven protrusion 73' which is moved along the selected operating groove 77'. As a result, dust on he outer surface of the filter 51 can be removed more effectively.

According to the embodiments of the present invention as described above, in the filter assembly of the cyclone type dust collecting apparatus of a vacuum cleaner, the filter 51 is rotated in association with the separation/connection of the dust receptacle 31. The rotation of the filter 51 by itself, or together with a brush 65 acting separately, causes dust to be completely removed from the outer surface of the filter 51.

The filter assembly of the cyclone type dust collecting apparatus according to the present invention requires a simple structure, and thus can be manufactured at an economic cost. Also, assembling/disassembling and disposal of the dust collected in the dust receptacle becomes simple. Furthermore, since there is no need to define a guide groove portion between the dust receptacle and the connecting pipe of the cyclone body, manufacturing processes become simpler.

Although the preferred embodiments are described above for purposes of illustration and description, the invention is not to be considered limited by the above description, but is to be considered as including any modifications, changes and alterations and the invention is to be limited only by the following claims.

What is claimed is:

1. A filter assembly for a cyclone type dust collecting apparatus of a vacuum cleaner, the cyclone type dust collecting apparatus centrifugally separating contaminants from an externally-drawn air and collecting the separated contaminants therein, the filter assembly for filtering contaminants floating in an air which is discharged through an exhaust port of the cyclone the dust collecting apparatus, comprising:

a rotary filter rotatably connected with respect to the exhaust port of the cyclone type dust collecting apparatus, the rotary filter including a suction grill portion disposed at the outer circumference and a discharge port in fluid communication with the exhaust port; and a filter rotating unit comprised of a connecting portion open in a downward direction with respect to an axis of the rotary filter: an operating bar extending upwardly from the bottom of the dust receptacle of the cyclone type dust collecting apparatus, for operating in association with the connecting portion of the rotary filter: and a rotation driving portion, disposed between the operating bar and the connecting portion, capable of rotating the rotary filter in association with the engagement and disengagement of the dust receptacle, the filter rotating unit for rotating the rotary filter within the dust collecting apparatus, thereby removing the contaminants filtered on the suction grill portion and depositing them into a removable dust receptacle engaged to the cyclone type dust collecting apparatus.

2. The filter assembly of claim 1, wherein the rotation driving portion comprises:

an operating groove formed on an outer surface of the operating bar extending along a lengthwise direction in a helical, screw-wise pattern; and a driven protrusion formed in the connecting portion corresponding to the operating groove and oriented with respect to the operating groove, whereby engagement of the groove with the protrusion causes the rotation of the rotary filter.

3. The filter assembly of claim 2, further comprising an operating bar guide protruding downwardly from the connecting portion of the rotary filter and having a divergent surface toward the operating bar.

4. The filter assembly of claim 1, further comprising an operating bar guide protruding downwardly from the connecting portion of the rotary filter and having a divergent surface toward the operating bar.

5. The filter assembly of claim 1, further comprising a rotation supporting portion disposed between the exhaust port and the rotary filter, for rotatably supporting the rotary filter.

6. The filter assembly of claim 5, further comprising a brush portion disposed adjacent an outer portion of the rotary filter for removing the contaminant filtered on the suction grill portion.

7. The filter assembly of claim 6, wherein the brush portion is formed on the rotation supporting portion.

8. The filter assembly of claim 1, further comprising a brush portion disposed adjacent an outer portion of the rotary filter for removing the contaminant filtered on the suction grill portion.

9. The filter assembly of claim 1, further comprising a filtering member disposed on the suction grill portion of the rotary filter.

10. The filter assembly of claim 1, wherein the rotation driving portion comprises:

an operating protrusion formed on an outer surface of the operating bar along a lengthwise direction and in a helical screw-wise pattern; and a driven groove formed in the connecting portion corresponding to the operating protrusion, whereby engagement of the groove with the protrusion causes the rotation of the rotary filter.

11. A filter assembly for use in a cyclone type dust collecting apparatus of a vacuum cleaner capable of filtering contaminants centrifugally separated from cyclonic air swirling within a dust receptacle, the cyclone type dust collecting apparatus having an exhaust port, the filter assembly comprising:

a cylindrical rotary filter, rotatably connected with respect to the exhaust port of the cyclone type dust collecting apparatus, including a suction grill portion disposed at the outer circumference of the rotary filter and a discharge port in fluid communication with the exhaust port of the cyclone type dust collecting apparatus; and a filter rotating unit for rotating the rotary filter, whereby rotation of the rotary filter by the filter rotating unit results in removal of contaminants filtered by the suction grill portion, said filter rotating unit comprised of:

a connecting portion opened in a downward direction with respect to an axis of the rotary filter;

an operating bar extending upwardly from the bottom of the dust receptacle of the cyclone type dust collecting apparatus, for operating in association with the connecting portion of the rotary filter; and a rotation driving portion, disposed between the operating bar and the connecting portion, capable of rotating the rotary filter in association with the engagement and disengagement of the dust receptacle.

12. The filter assembly of claim 11, wherein the rotation driving portion comprises:

an operating groove formed on an outer surface of the operating bar extending along a lengthwise direction in a helical, screw-wise pattern; and a driven protrusion formed in the connecting portion corresponding to the operating groove and oriented with respect to the operating groove, whereby engagement of the groove with the protrusion causes the rotation of the rotary filter.

13. The filter assembly of claim 11, wherein the rotation driving portion comprises:

an operating protrusion formed on an outer surface of the operating bar along a lengthwise direction and in a helical, screw-wise pattern; and a driven groove formed in the connecting portion corresponding to the operating protrusion, whereby engagement of the groove with the protrusion causes the rotation of the rotary filter.

14. The filter assembly of claim 11, further comprising a flared operating bar guide protruding downwardly from the connecting portion of the rotary filter and having a divergent surface toward the operating bar.

15. The filter assembly of claim 11, further comprising a rotation supporting portion disposed between the exhaust port and the rotary filter, for rotatably supporting the rotary filter.

16. The filter assembly of claim 15, further comprising a brush portion disposed adjacent an outer portion of the rotary filter for removing the contaminant filtered on the suction grill portion.

17. The filter assembly of claim 16, wherein the brush portion is formed on the rotation supporting portion.

18. The filter assembly of claim 11, further comprising a brush portion disposed adjacent an outer portion of the rotary filter for removing the contaminant filtered on the suction grill portion.

* * * * *